US012729527B2

(12) United States Patent
Manoj et al.

(10) Patent No.: US 12,729,527 B2
(45) **Date of Patent: *Sep. 8, 2026**

(54) POP UP STOPPER AND SEAL

(71) Applicant: Danco, Inc., Irving, TX (US)

(72) Inventors: Jon Manoj, Mesquite, TX (US); Robert Jones, Jr., Rockwall, TX (US)

(73) Assignee: Danco, Inc., Irving, TX (US)

( * ) Notice: Subject to any disclaimer, the term of this patent is extended or adjusted under 35 U.S.C. 154(b) by 189 days.

This patent is subject to a terminal disclaimer.

(21) Appl. No.: 18/437,825

(22) Filed: Feb. 9, 2024

(65) Prior Publication Data

US 2024/0183138 A1 Jun. 6, 2024

Related U.S. Application Data

(63) Continuation of application No. 17/480,288, filed on Sep. 21, 2021, now Pat. No. 11,927,001.

(60) Provisional application No. 63/084,957, filed on Sep. 29, 2020.

(51) Int. Cl.
*E03C 1/23* (2006.01)
*A47K 1/14* (2006.01)

(52) U.S. Cl.
CPC ..... *E03C 1/2302* (2013.01); *A47K 1/14* (2013.01)

(58) Field of Classification Search
CPC ..... E03C 1/262; E03C 1/23; A47K 1/14
See application file for complete search history.

(56) References Cited

U.S. PATENT DOCUMENTS

| | | | |
|---|---|---|---|
| 1,474,986 | A | 11/1923 | Watrous |
| 4,218,785 | A | 8/1980 | Crawford et al. |
| 5,363,518 | A | 11/1994 | Mowery |
| 5,996,143 | A | 12/1999 | Lordahl et al. |
| 6,061,847 | A | 5/2000 | Jourdan |
| 6,367,102 | B1 | 4/2002 | McMullen |
| 6,484,330 | B2 | 11/2002 | Gray et al. |
| 6,725,472 | B2 | 4/2004 | Gray et al. |
| 8,037,558 | B1 | 10/2011 | Chen |
| 8,327,474 | B2 | 12/2012 | Van Zeeland et al. |
| 8,370,970 | B2 | 2/2013 | Reavis |
| 8,590,065 | B2 | 11/2013 | Ali et al. |
| 8,739,328 | B2 | 6/2014 | Duncan |
| 9,243,393 | B1 | 1/2016 | Tidwell |
| 9,371,636 | B2 | 6/2016 | Ali |
| 9,499,962 | B2 | 11/2016 | Joseph |

(Continued)

*Primary Examiner* — Janie M Loeppke
(74) *Attorney, Agent, or Firm* — Scheef & Stone, LLP; Robin L. Barnes

(57) ABSTRACT

A pop up stopper comprising multiple aperture and at least one non-aperture lever rod engagement locations to allow use of the stopper as a replacement with different pre-existing actuating and drain systems when the existing stopper is broken, worn or needs to be replaced for aesthetic reasons. An existing lever rod is selectively positionable to engage with one of the lever rod engagement locations that are disposed at varying heights on the stopper. Most preferably, there are six lever rod engagement locations, four aperture locations and two non-aperture locations. A seal disposed below a cap and around a body of the stopper comprises an enlarged annular ring near its outer edge to provide increased surface area for sealing a drain opening. The body of the stopper has a maximum width measured in cross section of 1.04 inches or less.

31 Claims, 6 Drawing Sheets

(56) References Cited

U.S. PATENT DOCUMENTS

| | | | | |
|---|---|---|---|---|
| 9,593,472 | B2 | 3/2017 | Ye et al. | |
| D783,783 | S | 4/2017 | Yang | |
| 9,708,803 | B1 | 7/2017 | Lin et al. | |
| 9,745,728 | B2 | 8/2017 | Beck et al. | |
| 9,945,105 | B2 | 4/2018 | Ye et al. | |
| 9,945,106 | B2 | 4/2018 | Ali | |
| 10,240,329 | B2 | 3/2019 | Beck et al. | |
| 10,246,861 | B2 | 4/2019 | Beck et al. | |
| 10,494,800 | B2 | 12/2019 | Ahuja et al. | |
| 10,501,917 | B2 | 12/2019 | Ali | |
| 11,421,408 | B1 * | 8/2022 | Rosario | E03C 1/262 |
| 11,927,001 | B2 * | 3/2024 | Manoj | E03C 1/2302 |
| 2010/0275357 | A1 | 11/2010 | Fuoco et al. | |
| 2011/0126347 | A1 * | 6/2011 | Qian | E03C 1/2302 4/287 |
| 2014/0165275 | A1 * | 6/2014 | Zito | A46B 9/025 4/292 |

* cited by examiner

POP UP STOPPER AND SEAL

CROSS REFERENCE TO RELATED APPLICATION

This application is a continuation of U.S. application Ser. No. 17/480,288 filed on Sep. 21, 2021, which claims the benefit of U.S. Provisional Application No. 63/084,957 filed on Sep. 29, 2020.

BACKGROUND OF THE INVENTION

1. Field of the Invention

This invention relates to a pop up stopper and seal for a drain, such as a sink basin drain, with multiple rod engagement locations for engagement with an actuating rod to allow the stopper to be used with different pre-existing actuation systems.

2. Description of Related Art

Pop up stoppers are commonly used to allow a drain connected to a basin, such as a sink basin, to be sealed off to prevent flow of water through the drain or opened to allow flow of water through the drain. Such stoppers typically have a cap and a seal that engages with a drain opening or a flange around a drain opening in the basin (so that it remains above the drain opening) and a body that extends down into a drain body connected to the drain opening in the sink basin. A bottom end of the stopper body typically comprises an aperture that receives an end of a lever rod (or a ball rod or pivot rod) on an actuating system to actuate the stopper between a raised (or open) position and a lowered (or closed or sealed) position. Actuating systems typically have a pull or lift rod located near the faucet, an extension rod connected to the pull rod, and a lever rod connected to the extension rod. An end of the lever rod distal from the extension rod is inserted through an aperture in a drain body that connects the basin to a drain pipe and inserted through the aperture in the bottom end of the stopper body. A retention nut secures the lever rod in position, allowing the distal end of the lever rod to move down (pulling the stopper down to the closed position) when the pull rod is pulled up or the lever rod to move up (pushing the stopper up to the open position) when the pull rod is pushed down.

Typically, an entire drain assembly is sold as a kit comprising a stopper, a drain body, and the actuating system, with the actuating system specifically designed for use with a particular stopper body having an aperture that aligns with the lever rod. If the original stopper becomes worn or replacement is needed for aesthetic reasons, it may be difficult to find a suitable replacement stopper as many prior art replacement stoppers only have a single aperture, or two apertures, at the bottom of the stopper body, which may be at a slightly different location (height) compared to the original stopper so the original lever rod does not align with the new stopper aperture to allow proper functioning of the stopper.

Several prior art stoppers have attempted to address this problem with different aperture configurations to allow for a more universal fit with existing actuating systems so that the stopper can be replaced without having to replace the entire drain assembly. For example, U.S. Pat. No. 6,367,102 discloses a stopper body having two spaced apart legs that form a slot open at the bottom. Each leg has set of spaced apart, vertically aligned, separate (non-connected) apertures to receive a lever rod, allowing the lever rod to be inserted in any one of the apertures. As another example, U.S. Pat. No. 8,370,970 discloses a prong design open at the bottom with a single aperture or two connected apertures. The bottom of the prongs are designed to flex apart to allow the lever rod to be inserted from the bottom. As yet another example, U.S. Pat. No. 10,246,861 discloses a stopper body having a series of vertically aligned, connected apertures forming a notched channel that is open at the bottom end, making a pronged configuration to receive the lever rod in any one of the notches in the channel. The '861 patent also discloses a stopper body with a pair of prongs having smooth interior surfaces lined with an elastomeric material, the prongs forming a channel that is open at the bottom to receive a lever rod at any location along the channel with the lever rod held in position by frictional engagement with the elastomeric material. By having an open bottom end, these prior art stoppers may allow the lever rod to become dislodged or disengaged from the stopper body by slipping out of the bottom of the channel, so the stopper would no longer function properly. Insertion of a lever rod into a channel from a bottom opening in the channel where the prongs are forced to flex apart may also weaken the prongs making them more likely to break, particularly if an inexperienced user has to make multiple adjustments in lever rod location when installing the stopper. Additionally, the non-notched embodiment of the '861 patent may allow the lever rod to slip upward or downward if the elastomeric material becomes worn or experiences compression set, which would also negatively impact the functionality of the stopper.

Additionally, many prior art replacement stoppers have stopper body parts that are too wide to fit into certain drain openings or that have lower bodies that are wider than the upper bodies that may make installation into a drain opening more difficult. For example, the '861 patent discloses an upper body with fins that are the same width over the entirety of the upper body (other than the shoulders) and opposed flow diverter plates that form the lower body of the stopper and the distance between the bottoms of the opposed diverter plates is wider than the upper stopper body.

Although these prior art stoppers are an improvement over typical single or double aperture stoppers, there is still a need for even greater flexibility in engaging an existing lever rod with a replacement stopper so that the stopper can be replaced without having to replace the entire drain assembly and still function properly to open and close the drain opening. There is also a need for a replacement stopper that is sized to fit in more drain openings and configured for ease of installation to provide a more universal replacement capability.

SUMMARY OF THE INVENTION

Preferred embodiments provide a stopper that is usable with multiple different original actuating system configurations to allow an existing stopper to be replaced with a stopper according to a preferred embodiment of the invention without having to replace an entire drain assembly. According to one preferred embodiment, a stopper comprises a cap, a stopper body, and a plurality of vertically spaced lever rod engagement locations disposed on the stopper body, each configured to selectively engage with an existing lever rod, allowing the lever rod to be positioned at varying height locations on the stopper body to ensure the stopper functions properly. Preferably at least two of the lever rod engagement locations comprise aperture locations and at least third of the lever rod engagement locations comprises a non-aperture location. According to various preferred embodiments, there are three to six (or more) lever rod engagement locations. Most preferably, the stopper body does not comprise any prongs, legs, or channels that are open at a bottom end. Stoppers according to preferred embodiments are moveable between a raised or open position that allows flow through a basin drain opening and a lowered or closed position that blocks flow through the basin drain opening.

According to another preferred embodiment, a stopper is actuated by a lever rod in an actuating system (1) to push the stopper to a raised position when the lever rod is engaged with one of the aperture locations or a non-aperture location; (2) to pull the stopper to a lowered position when the lever rod is engaged with one of the aperture locations; (3) the stopper falls to the lowered position by gravity when the lever rod disengages with the at least one non-aperture location.

According to another preferred embodiment, a stopper body comprises (1) at least two rod engagement locations, each configured to be engageable with at least a portion of a top surface and at least a portion of a bottom surface of an end of a lever rod and (2) at least one, preferably at two, rod engagement locations configured to be engageable with at least a portion of the top surface and no portion of the bottom surface of the end of the lever rod.

According to another preferred embodiment, the stopper body comprises an upper body and a lower body. The upper body comprises a plurality of fins. The lower body comprises a connector plate and a connector body extending downwardly from the connector plate. According to another preferred embodiment, the stopper body has a maximum width as measured in cross section of 1.04 inches. Most preferably, the maximum width is at an upper portion of the plurality of fins, preferably at an upper outwardly projecting tab (such that a circle disposed around an outer edge of the upper tab would have a diameter of 1.04 inches or less). This aids in the stopper body being small enough to be easily inserted into a variety of drain openings of different sizes while also having the stopper body be large enough to be substantially stable and not wobbly inside the drain opening and upper drain body.

According to another preferred embodiment, the at least two aperture locations are disposed on the connector body and the non-aperture location is disposed on (1) a bottom end of the connector body or (2) a bottom surface of a connector plate disposed above the connector body or (3) both (when there are two non-aperture locations). According to another preferred embodiment, a bottom end of the connector body is arcuate. According to another preferred embodiment, a bottom surface of the connector plate comprises a notch configured to receive a portion of a lever rod.

According to another preferred embodiment, a first aperture location is disposed on an upper end of the connector body and comprises a substantially D-shaped aperture and a second aperture location is disposed below and separated from the first aperture location. According to another preferred embodiment, the second aperture location comprises a substantially circular aperture and there is at a third aperture location disposed below and separated from the second and comprising a substantially circular aperture. According to another preferred embodiment, the second aperture location comprises a set of at least two, preferably three, connected or overlapping apertures that form a notched vertical channel that is closed at its upper and lower ends and each of the connected apertures is configured to selectively receive a lever rod. According to another preferred embodiment the lever rod is moveable between the at least two connected apertures without removing the lever rod from either of the connected apertures.

According to another preferred embodiment, the stopper further comprises a seal disposed below the cap and around an upper portion of the stopper body. Most preferably, the seal comprises a central aperture, an annular central body extending outwardly from the central aperture, an annular central disk extending outwardly from the central body, an annular ring extending outwardly from the central disk, and an outer flange extending outwardly from the ring. According to another preferred embodiment, the ring has a height that is greater than a height of the central disk and greater than a height of the outer flange and less than a height of the central body. According to another preferred embodiment, the ring has a height of around 0.080 to 0.060 inches. The configuration of the ring aids in creating a tight seal between the stopper cap and the basin drain opening by providing additional surface area than would be provided if the shorter outer flange connected directly to the central body.

According to another preferred embodiment, the upper body has a central longitudinal axis and the connector body is disposed in a position parallel to and offset from the central longitudinal axis. According to one preferred embodiment, a first aperture rod engagement location is disposed at an upper end of the connector body, a second aperture rod engagement location is disposed below the first aperture location on the connector body, a third non-aperture engagement location is disposed on a bottom surface of the connector plate, and a fourth non-aperture location is disposed on a bottom end of the connector body.

According to one preferred embodiment, a method of installing a replacement pop up stopper comprising a stopper body and a plurality of vertically spaced lever rod engagement locations (preferably including at least two aperture locations and at least one non-aperture location) disposed on the stopper body, each configured to selectively engage with an end of a lever rod comprises (1) inserting the stopper body through a basin drain opening and into a drain body connected to the basin drain opening; and (2) engaging a select one of the plurality of lever rod engagement locations with the end of the lever rod disposed through an opening in the drain body. According to another preferred embodiment, the method further comprises (3) testing the stopper to determine if it functions properly to actuate between an open position to allow flow through a basin drain opening when the engaged end of the lever rod is in a first position and a closed position that blocks flow through the basin drain opening when the engaged end of the lever is in a second position and (4) repeating the engaging step with a different selected lever rod engagement location if the stopper does not function property. Most preferably, the engaging step comprises aligning the lever rod with one of the aperture locations and inserting the lever rod through the aperture or aligning the lever rod with one of the non-aperture locations and allowing an upper surface of the rod to engage or contact the connector body at the non-aperture location.

Preferred embodiments allow the stopper to be used as a replacement stopper for many different actuating system configurations and different drain opening. These embodiments allow for multiple points of engagement for a lever rod to actuate the stopper to provide greater flexibility in engaging an existing lever rod with a replacement stopper so that the stopper can be replaced without having to replace the entire drain assembly and still function properly to open and close the drain opening, provide increased contact area to fully seal the drain opening when the stopper is in a closed position, and allow for easy installation and insertion of the stopper in an existing a drain opening by being sized to fit in more drain openings while still retaining stability and are configured for ease of installation to provide a more universal replacement capability.

BRIEF DESCRIPTION OF THE DRAWINGS

Preferred faucet handle embodiments of the invention are further described and explained in relation to the following drawings

DESCRIPTION OF THE PREFERRED EMBODIMENTS

Figure 3A:
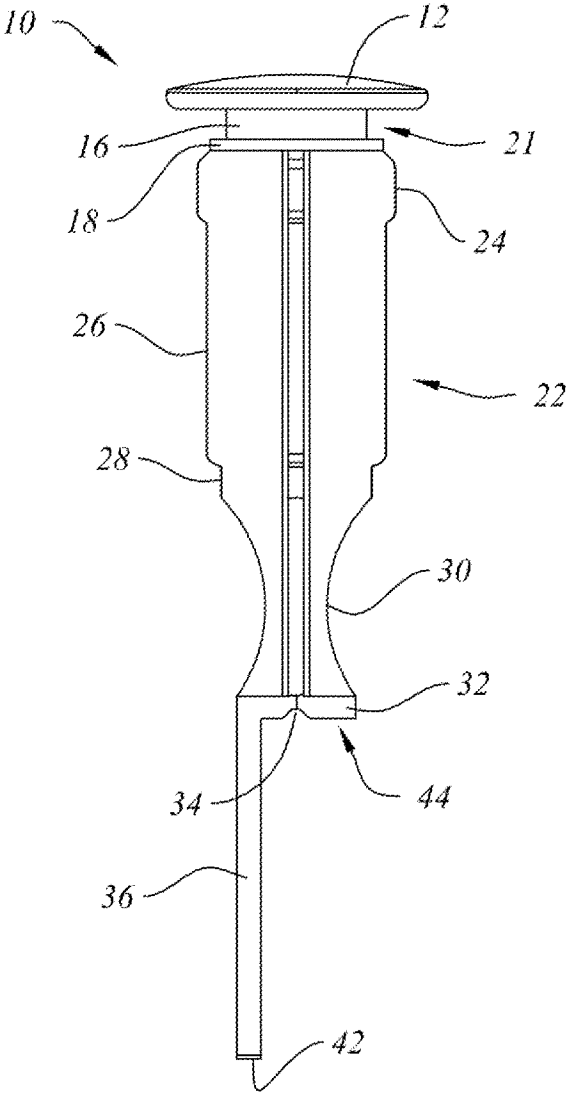
FIG. 3A is a side elevation of the pop up stopper of FIG. 1.

One preferred embodiment of pop up stopper 10 is shown in FIGS. 1-6 and 9-10. Pop up stopper 10 preferably comprises a cap 12, a stopper upper body 14, and a stopper lower body 20. Stopper 10 may be used as a replacement stopper when an original stopper (such as one sold with a faucet or a drain assembly) is worn or broken or needs to be changed for aesthetic reasons). When installed, stopper cap 12 remains above a drain opening in a basin, such as a sink, and stopper upper body 14 and stopper lower body 20 are inserted into the drain. Stopper cap 12 is preferably substantially round with a slightly domed upper surface. Cap 12 preferably has a diameter of around 1.3 to 1.4 inches, most preferably around 1.38 inches, to sufficiently cover most drain openings to allow the opening to be plugged to stop flow through the drain when stopper 10 is in a lowered position relative to the drain opening or open to allow flow through the drain when stopper 10 is in raised position relative to the drain opening.

Stopper upper body 14 preferably comprises a substantially cylindrical neck 16 disposed below cap 12 and extending downwardly from cap 12, an annular collar 18 disposed near a bottom end of neck 16, and a plurality of spaced-apart fins 22 disposed below and extending downwardly from annular collar 18. A longitudinal central axis 48 extends through a center of upper stopper body 14. Neck 16 is preferably around 0.15 to 0.17 inches long, most preferably 0.16 inches long, and has a diameter or width of around 0.70 to 0.80 inches, most preferably around 0.75 inches. Collar 18 is preferably around 0.055 to 0.065 inches long, most preferably 0.06 inches long, and has a diameter or width of around 0.9 to 0.92 inches, most preferably around 0.91 inches. A recessed area 21 is disposed between cap 12 and collar 18 to receive seal 50 around neck 16.

Figure 4:
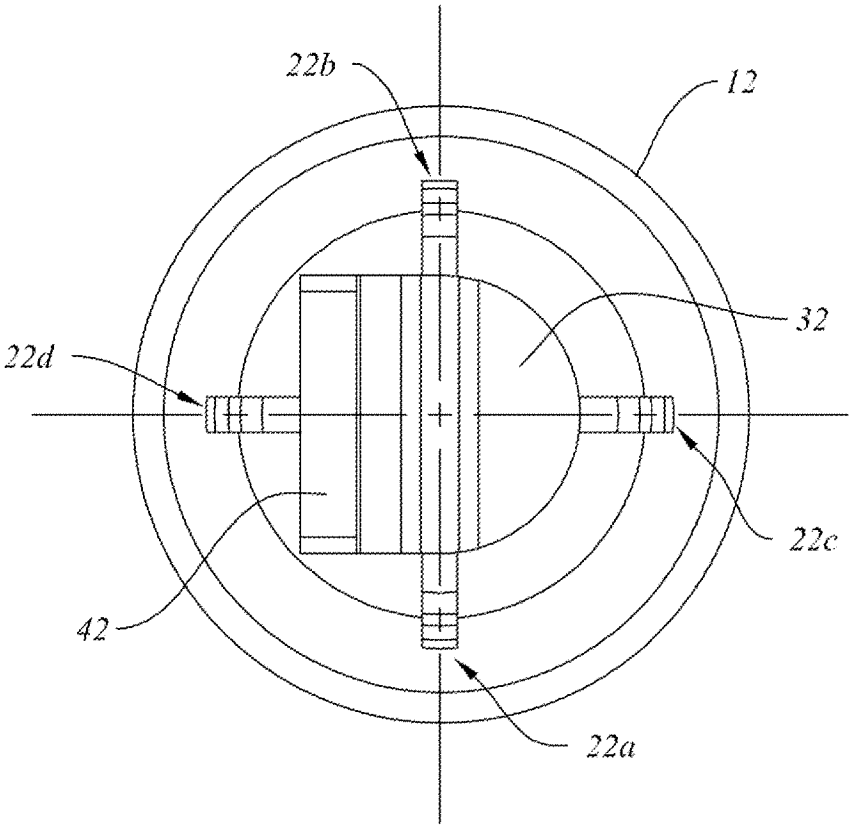
FIG. 4 is a bottom plan view of the pop up stopper of FIG. 1.

Each spaced apart fin 22 preferably comprises an upper tab 24 disposed below collar 18, a fin central body 26 disposed below tab 24, a lower recessed tab 28 disposed below fin central body 26, and fin lower body 30 disposed below lower recessed tab 28. Transitional shoulders 23, 25, 27, and 29 are preferably disposed at transition points between annular collar 18, upper tab 24, fin central body 26, lower recessed tab 28 and fin lower body 30. Most preferably, stopper 10 comprises four fins 22*a*, 22*b*, 22*c*, 22*d* (as shown in FIG. 4), each disposed at a 90° angle from an adjacent fin 22, but other fin arrangements and fewer or more fins may also be used.

A circle disposed around an outer edge of each upper tab 24 preferably has a diameter of 1.04 inches or less. A circle disposed around an outer edge of each fin central body 26 preferably has a diameter that is smaller than the diameter of a circle disposed around an outer edge of each upper tab 24 and is preferably around 0.85 to 0.95 inches, most preferably around 0.95 inches or less. A circle disposed around an outer edge of each recessed lower tab 28 preferably has a diameter that is smaller than the diameter of a circle disposed around an outer edge of each fin central body 26 and is preferably around 0.75 to 0.85 inches, most preferably around 0.80 inches. Fin lower body 30 is preferably arcuate, having a radius of around 0.80 to 0.85 inches, most preferably around 0.82 inches. A circle disposed around an upper portion of each fin lower body 30 preferably has a diameter that is the same as that for recessed lower tab 28. A circle disposed around a central portion of each fin lower body 30 (at its narrowest or smallest diameter point) preferably has a diameter of around 0.30 to 0.35 inches, most preferably around 0.32 inches. A circle disposed around a lower or bottom portion of each fin lower body 30 preferably has a diameter of around 0.6 to 0.65 inches, most preferably around 0.62 inches. An outer bottom edge of each fin lower body is preferably coextensive with an outer edge of a connector plate 32. Stopper upper body 14 preferably has a length of around 3 to 3.2 inches, most preferably around 3.10 inches.

Figure 2:
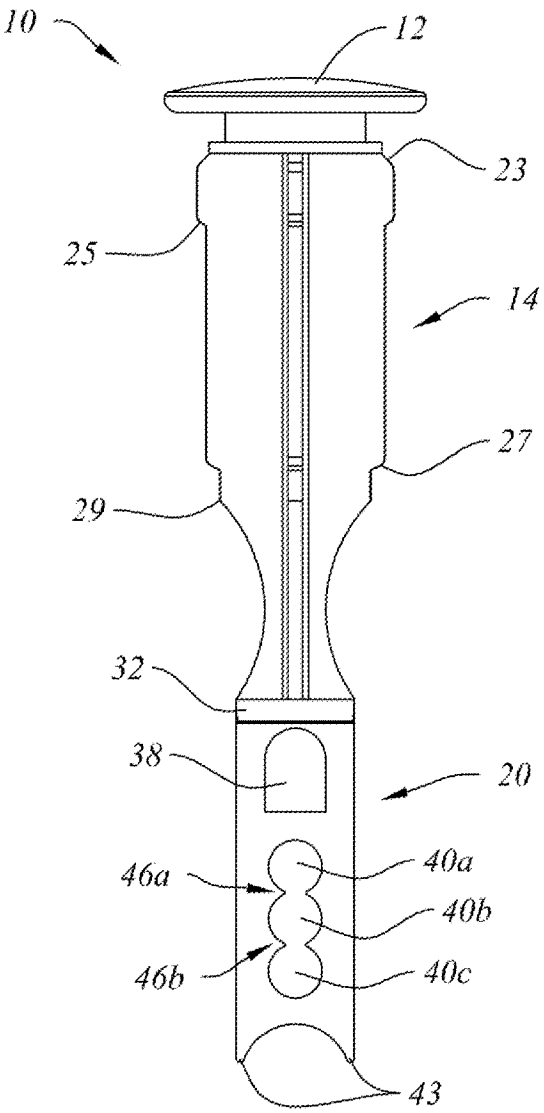
FIG. 2 is a front elevation of the pop up stopper of FIG. 1.
Figure 1:
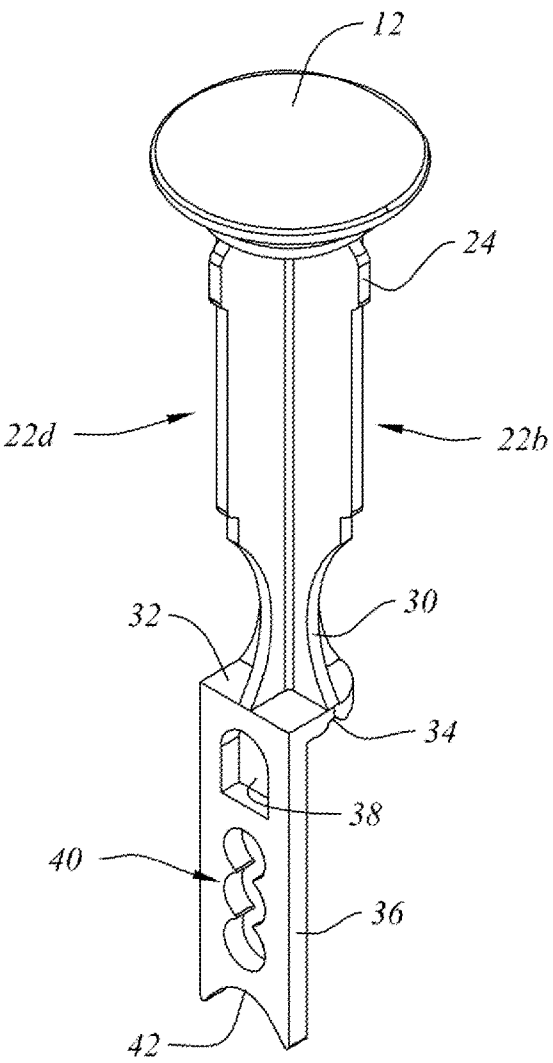
FIG. 1 is a perspective view of a pop up stopper according to a preferred embodiment of the invention.
Figure 3B:
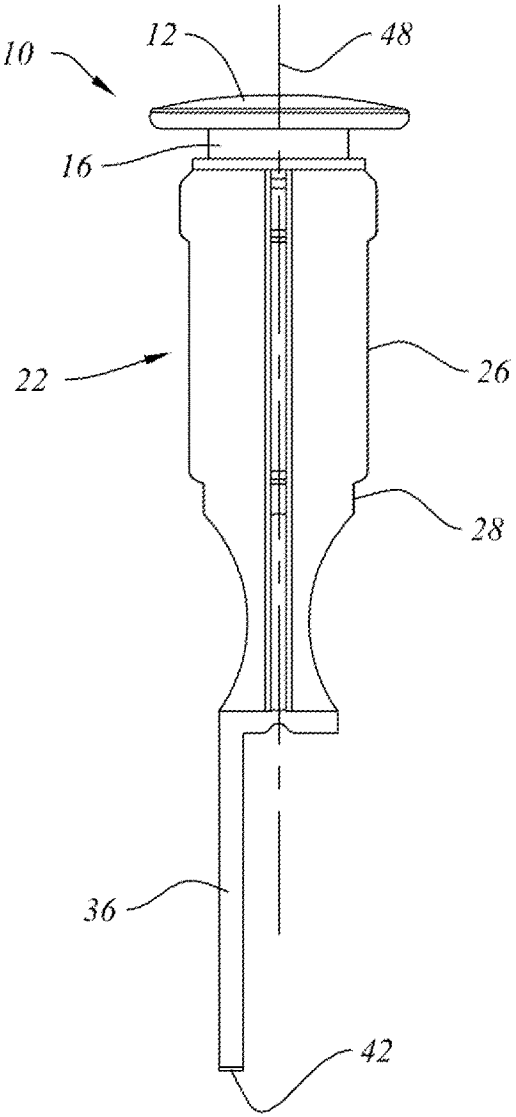
FIG. 3B is the same side elevation of FIG. 3A showing a longitudinal central axis through the stopper.

Stopper lower body 20 preferably comprises a connector plate 32 and a downwardly extending connector body 36. Connector body 36 is preferably disposed at a 90° to connector plate 32. Stopper lower body 20 preferably has a length of around 1.8 to 2 inches, most preferably around 1.92 inches long and a width of around 0.6 to 0.65 inches, most preferably around 0.62 inches. Connector plate 32 on stopper lower body 20 preferably comprises a D shape, with a rounded side and at least one straight side (as shown in FIG. 4) disposed opposite the rounded side. Connector plate 32 is preferably around 0.1 to 0.125 inches high (in a direction parallel with longitudinal axis 48) and around 0.6 to 0.65 inches wide across a front/rear face (as shown in the orientation of FIG. 2) and across a side face (as shown in the orientation of FIG. 3). A radius of the rounded side of connector plate 32 is preferably around 0.3 to 0.32 inches, most preferably around 0.31 inches. Connector body 36 extends downwardly from the straight side of connector plate 32 and is offset from longitudinal central axis 48 by a horizontal distance of around 0.18 to 0.32 inches, most preferably around 0.25 inches. Connector body is preferably around 0.6 to 0.65 inches wide across a front/rear face (as shown in the orientation of FIG. 2), most preferably around 0.62 inches wide and is preferably around 0.1 to 0.14 inches thick across a side face (as shown in the orientation of FIG.

Figure 5:
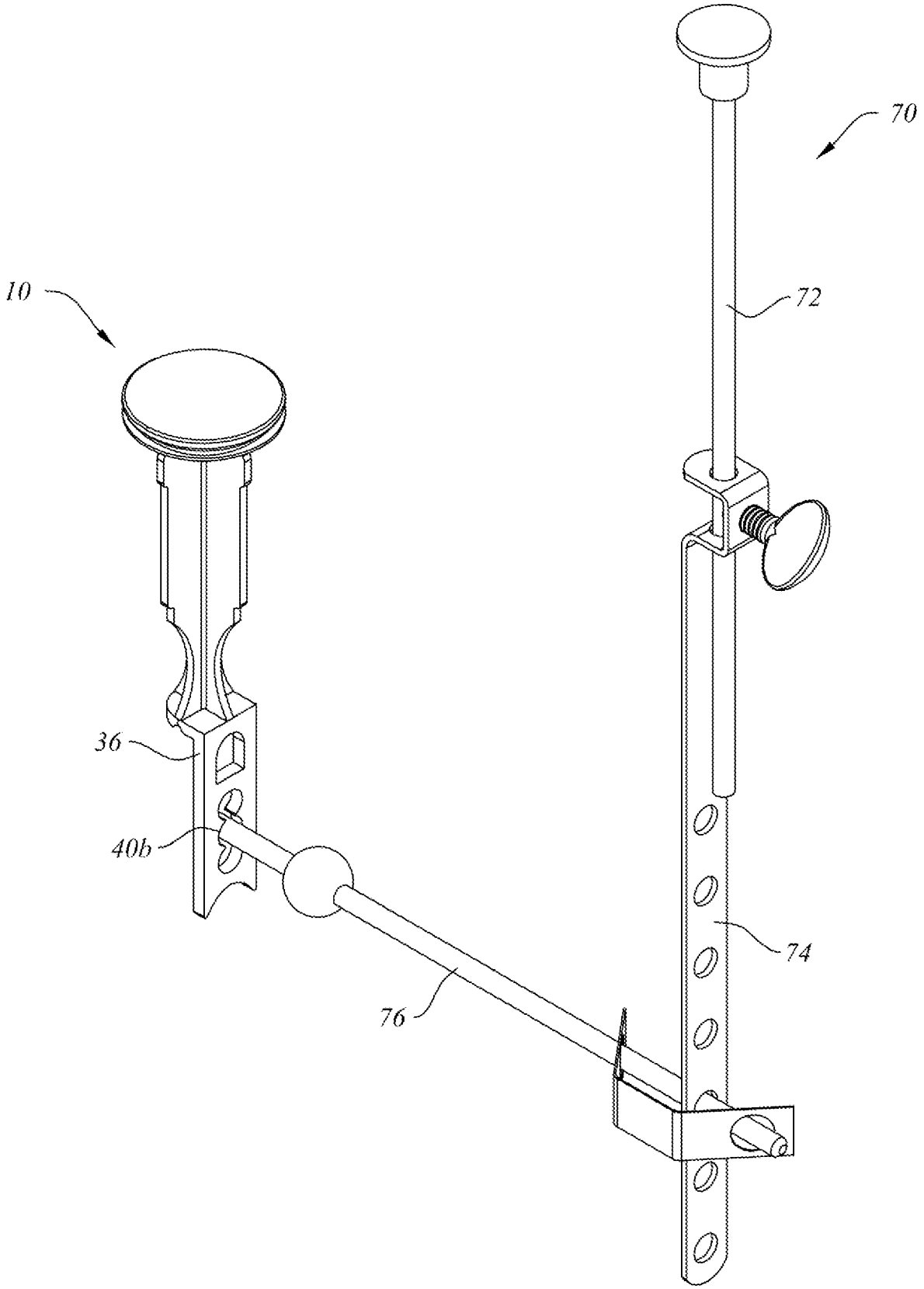
FIG. 5 is a perspective view of the pop up stopper of FIG. 1 connected to an exemplary actuation system.
Figure 6:
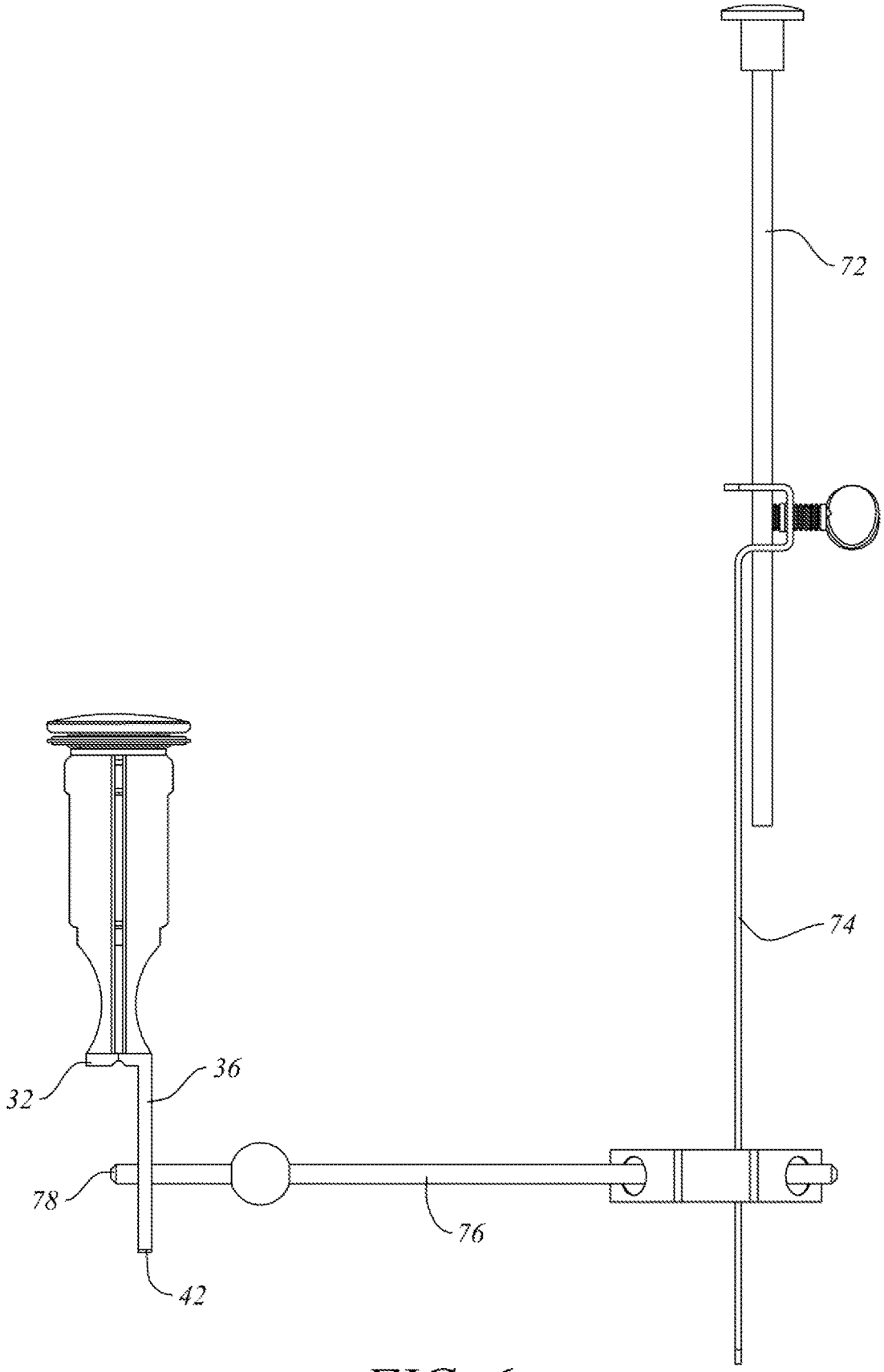
FIG. 6 is a side elevation view of the pop up stopper and exemplary actuation system of FIG. 5.
Figure 8B:
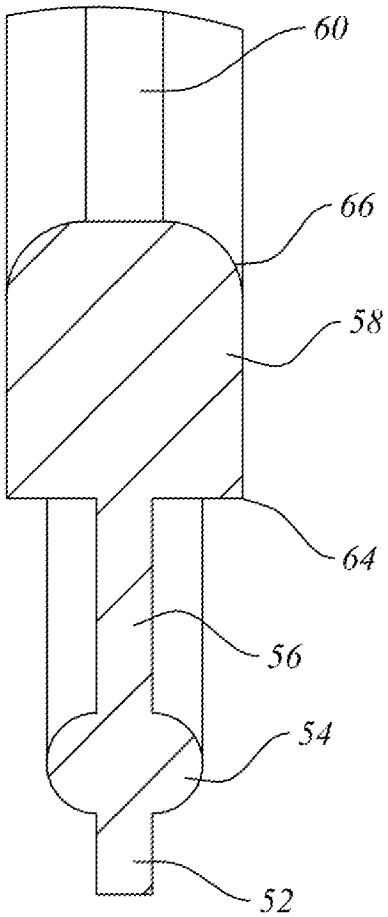
FIG. 8B is a detailed view of a portion of FIG. 8A.
Figure 8A:
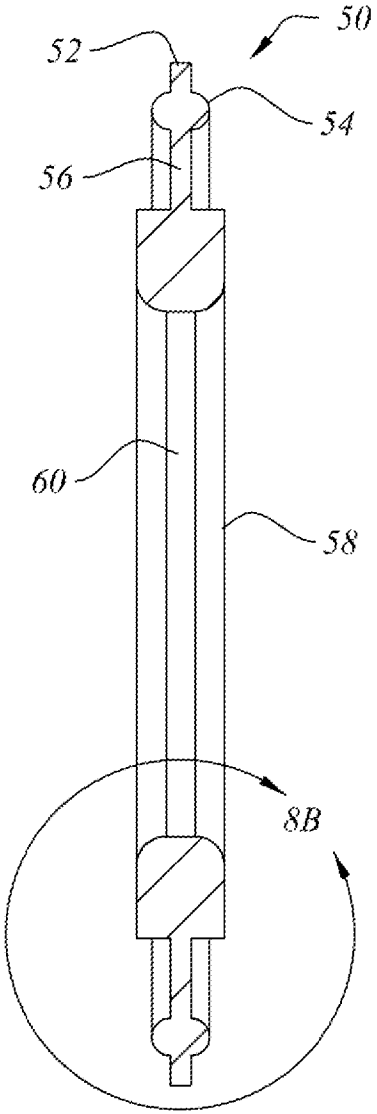
FIG. 8A is a cross sectional view of the seal of FIG. 7.
Figure 7:
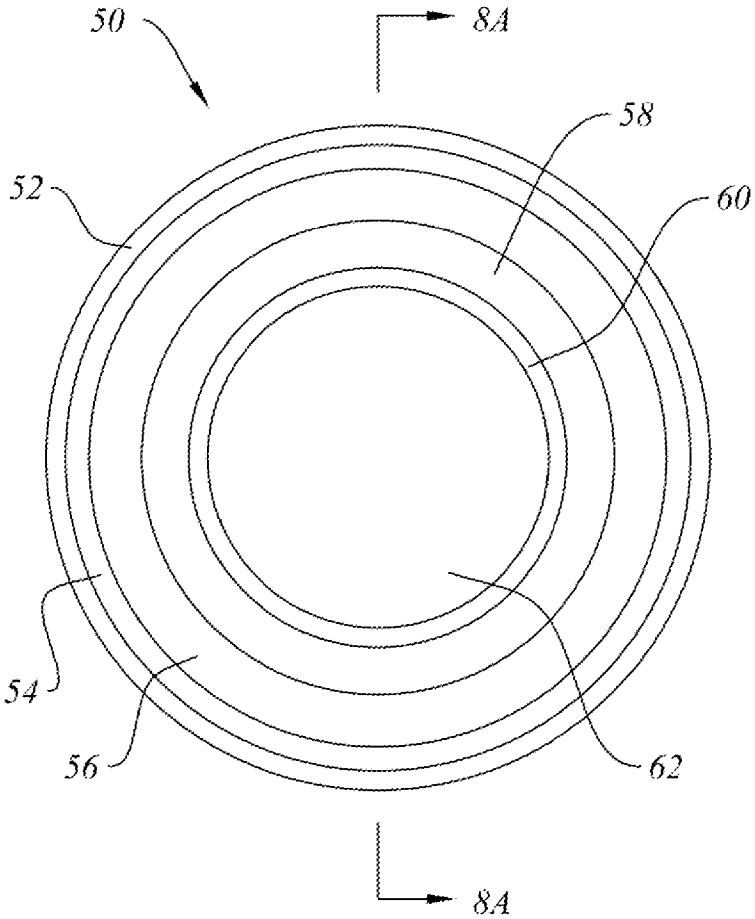
FIG. 7 is a top plan view of a seal according to a preferred embodiment of the invention.
Figure 10:
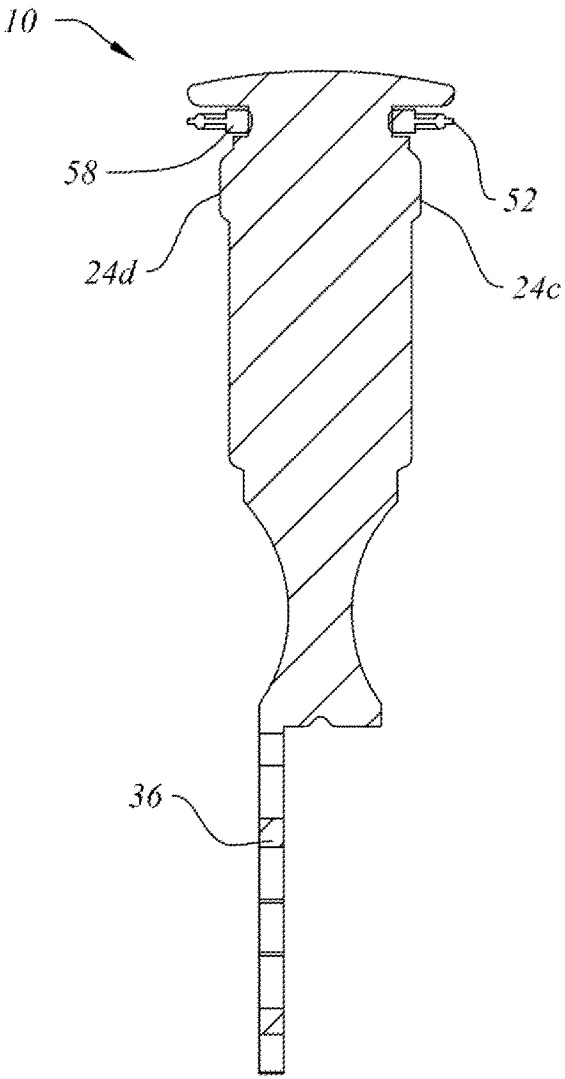
FIG. 10 is a side elevation cross sectional view of the pop up stopper of FIG. 3A and the seal of FIG. 7.

3), most preferably around 0.13 inches thick. Connector body 36 comprises a plurality of spaced apart, vertically aligned rod engagement locations that allows a lever rod 76 that is part of an actuator system 70 (as shown in FIGS. 5-6) to selectively engage with stopper 10 at different vertical positions to allow stopper 10 to be used with different actuator systems to move stopper 10 between a raised (open) position to a lowered (closed or sealed) position when a user moves pushes or pulls on rod 72. As will be understood by those of ordinary skill in the art, an actuator system 70 generally comprises a pull (or lift) rod 72 connected to an extension rod 74 and a lever (or ball or pivot) rod 76 that is connected to the extension rod 74. The actuator system 70 shown in FIGS. 5-6 is exemplary and other types of actuator systems may also be used with stopper 10. Having multiple rod engagement locations allows stopper 10 to be compatible with many different pre-existing actuator systems 70 by allowing for rod 76 to selectively engage stopper 10 at various heights or vertical positions along connector body 36.

Several rod engagement locations comprise a plurality of vertically aligned apertures, such as apertures 38 and 40, disposed through connector body 36, each configured to receive an end 78 of a lever rod 76 on an actuator system 70 (as shown in FIGS. 5-6, for example). When inserted through an aperture 38 or 40, lever rod 76 preferably is capable of engaging with an upper end and a lower end of the aperture, forming a removable physical connection between rod 76 and connector body 36, to allow rod 76 to push stopper 10 up to a raised (open) position and to pull stopper 10 down to a lowered (sealed) position.

Most preferably, one of the spaced apart apertures is aperture 38. Aperture 38 is preferably substantially elongated D shaped, having a rounded upper end, straight vertical sides, and a straight lower end, but other shapes may also be used. Most preferably, aperture 38 is the upper most aperture in connector body 36. Rounded upper end of aperture 38 preferably has a radius of around 0.15 to 0.175 inches, most preferably around 0.17 inches, giving aperture 38 a length of around 0.4 to 0.5 inches, most preferably around 0.44 inches, at its highest point. Aperture 38 preferably has a width between of around 0.3 to 0.4 inches, most preferably around 0.33 inches, at its widest point between its vertical sides. The bottom of aperture 38, along its lower end, is preferably disposed around 0.45 to 0.5 inches from a bottom of connector plate 32, most preferably around 0.475 inches, in a vertical direction.

One or more substantially circular apertures 40 (such as 40*a*, 40*b*, 40*c*, etc.), or a set of two or more connected apertures, are preferably disposed below aperture 38, each forming another rod engagement location. Each circular aperture preferably has a radius of around 0.13 to 0.15 inches. Most preferably there is a set of overlapping or connected apertures 40 disposed below aperture 38. Apertures 40 most preferably comprise three circular apertures with the top and bottom circles overlapping the middle circle, forming a set of connected apertures or connected notched apertures 40*a*, 40*b*, 40*c* that are closed at the upper and lower ends. Although three overlapping apertures in substantially circular shape are preferred and shown in the figures, two overlapping apertures or four or more overlapping apertures may also be used and the apertures may have one or more other shapes, such as a substantially diamond shape, a substantially oval shape, or a substantially square shape. Each of the notched apertures preferably has a diameter or width of around 0.275 to 0.3, most preferably around 0.29 inches, which is truncated where the circles overlap forming a narrowed passage 46*a*, 46*b* between the notched apertures. The width of each passage 46*a*, 46*b* is preferably around 0.1 to 0.12 inches, most preferably around 0.11 inches. Each of the circular apertures or notched apertures 40 disposed below aperture 38 is preferably configured to receive an end 78 of lever rod 76, shown as inserted through aperture 40*b* (for example) in FIGS. 5-6. Most preferably, notched apertures 40 are configured so that the passage 46*a*, 46*b*, etc., or point of connection, between the apertures (or each one of a set of two or more connected apertures) is too small to allow a lever rod inserted into one aperture (such as aperture 40*a*) to be moved through a passage (such as 46*a*) to the next aperture (such as 40*b*) to adjust the selected aperture for engagement with lever rod 76. Most preferably, a user must remove lever rod 76 from one aperture in aperture set 40 (such as 40*a* or 40*b*) to move the rod 76 to engage with another aperture in aperture set 40 (such as 40*b* or 40*c*). Although not preferred, as an alternative passages 46, or points of connection between each one of a set of two or more connected apertures, allow lever rod 76 to be adjusted up or down from one aperture (e.g. 40*a*) to another (e.g. 40*b*) by passing through a point of connection between them by applying force on stopper 10 during installation, without having to remove lever rod 76 from an aperture (e.g. 40*b*) to insert it in another aperture (e.g. 40*c*), to achieve the desired final installing position of rod 76 relative to stopper 10. However, the narrowed passages (e.g. 46*a*, 46*b*) between notched apertures are preferably sized to retain lever rod 76 in the final installation position during normal use of stopper 10 and any actuation system 70 with which stopper 10 is used. As an alternative, one or more separate (non-overlapping or not having connected interiors) circular (or other shaped) apertures may also be used in addition to or in place of one or more of the overlapping apertures 40.

A vertical distance between the bottom of aperture 38 and the top of notched apertures 40 (the top of the uppermost notched aperture 40*a*), or the top of the next lower separate aperture, is preferably around 0.14 to 0.16 inches, most preferably 0.15 inches. The length of the set of notched apertures (e.g. 40*a*, 40*b*, 40*c*) from an upper most end to a lower most end is preferably around 0.8 to 0.9 inches, most preferably around 0.83 inches. For a set of three separate (non-overlapping) apertures, the length from an upper most end of the set to a lower most end of the set is preferably around 0.85 to 1.1 inches, which is longer than the preferred range for notched (overlapping) apertures 40. For a separate apertures design, an uppermost aperture of the set is preferably around 0.15 inches below the D shaped aperture 38 (distance measured from the top section of the uppermost aperture in the set and the bottom most point of 38). The other two apertures are preferably spaced around 0.045 to 0.050 inches below the previous aperture. Using a set of notched apertures 40*a*, 40*b*, 40*c*, allows the holes to be placed closer together than would be achievable with separate (non-overlapping) apertures, which allows for smaller incremental height adjustments in selecting a rod engagement location between apertures 40*a*, 40*b*, and 40*c*. If separate apertures are used, the space between the bottom of one aperture and the top of the aperture below it is preferably around 0.03 to 0.06 inches. A lower most end of the lowest connected aperture (such as aperture 40*c*) is preferably disposed around 0.97 to 0.99 inches, most preferably 0.98 inches, below a bottom surface of connector plate 32. A lower most end of the lowest separate aperture is preferably disposed around 1.05 to 1.15 inches, below a bottom surface of connector plate 32.

Another rod engagement location 44 is a bottom side of connector plate 32. End 78 of lever rod 76 may be disposed to engage with a bottom surface of connector plate 32 to raise stopper 10 to its raised open position. When this rod engagement location 44 is used, stopper 10 is oriented with connector body 36 disposed away from extension rod 74, as opposed to connector body 36 being disposed toward extension rod 74 as shown in FIGS. 5-6, so that rod 76 can engage with a bottom surface of connector plate 32 without interference from connector body 36. Most preferably, a notch 34 is disposed on a lower surface of connector plate 32, aligned to intersect longitudinal axis 48 perpendicularly (and aligned parallel to a width of connector body 36). Notch 34 is preferably configured to receive a portion of a lever rod 76 to aid in engaging stopper 10 with rod 76 so that rod 76 does not slip along a bottom surface of connector plate 32. Most preferably, notch 34 is rounded with a radius of around 0.04 to 0.06 inches, most preferably 0.05 inches, but other sizes and shapes configurable to receive a lever rod 76 may be used. When an aperture rod engagement location 38, 40 is used, stopper 10 is preferably oriented with connector body 36 toward extension rod 74 (as shown in FIGS. 5-6), but may also be may be oriented with connector body 36 disposed away from extension rod 74 (rotated 180° from the position in FIGS. 5-6) provided lever rod 76 is long enough to allow insertion of end 78 through aperture 38 or 40 (or 40*a*, 40*b*, 40*c*, etc.).

Still another rod engagement location is a bottom end 42 of connector body 36. A portion of rod 76 may be disposed to engage with end 42 to raise stopper 10 to its raised open position. When this rod engagement location 42 is used, stopper 10 may be oriented with connector body 36 disposed away from extension rod 74 or toward extension rod 74 (as shown in FIGS. 5-6), depending on the length of lever rod 76. End 42 may be straight or flat, but is preferably shaped to aid in receiving and retaining a portion of rod 76. Most preferably, end 42 is arcuate across its width, having a radius preferably between around 0.4 to 0.6 inches. The length of the arc between the lower most sides of end 42 (at points 43) and the top of the arc is preferably between 0.175 and 0.185 inches, most preferably around 0.18 inches. End 42 may also have a more pointed shape to form a notch to receive a portion of rod 76. End 42 is preferably disposed below the lowermost aperture 40. Most preferably, the distance between the bottom of the lowermost aperture 40 and end 42 (or the top of an arc or point on end 42) is between around 0.13 to 0.14 inches, most preferably around 0.135 inches.

In the aperture rod engagement locations 38 and 40 (or 40*a*, 40*b*, 40*c*, etc.), both a top surface (or portion of a top half) and a bottom surface (or a portion of a bottom surface) of rod 76 are engagement with connector body 36 to actuate stopper. When end 78 of lever rod 76 is pushed up, a top surface (or portion of a top half) of rod 76 contacts an upper surface of an aperture 38, 40*a*, or a portion of apertures 40*b* or 40*c* at the notched area and when end 78 of lever rod 76 is pushed down, a bottom surface (or portion of a bottom half) of rod 76 contacts a lower surface of an aperture 38, 40*c*, or a portion of apertures 40*a* or 40*b* at the notched area, thereby providing two contact points between rod 76 and connector body 36. In the non-aperture rod engagement locations, rod 76 does not engage with or contact connector body 36 with both a top and bottom surface of the rod 76 when the rod is actuated like it is when end 78 is inserted through one of the apertures 38 or 40, but still engages with connector plate 32 (or preferably notch 34) or bottom end 42 to allow stopper 10 to be raised when pull rod 72 is pushed down and to maintain stopper 10 in a raised position until pull rod 72 is pulled up. Only a top surface (or a portion of a top half) of lever rod 76 engages with or contacts the non-aperture rod engagement locations 32 (or 34) or 42. Most preferably, when pull rod 72 is pulled up, lever rod 76 moves away (downward) from connector plate 32 (or notch 34) or bottom end 42, allowing stopper to fall by gravity until cap 12 and seal 50 engage with the basin around the drain opening or until connector plate 32 (or notch 34) or bottom end 42 contacts lever rod 76 again. Alternatively, if stopper 10 does not fall by gravity when lever rod 76 moves downward (such as if there is debris around upper stopper body 14 or lower stopper body 20 within the drain pipe), it may be necessary to push cap 12 downward from within the basin to engage seal 50 with the drain opening or engage connector plate 32 (or notch 34) or bottom end 42 with lever rod 76 in its lowered position.

Stopper 10 preferably has at least four rod engagement locations, more preferably stopper 10 has at least 6 rod engagement locations. Preferably, at least two, and more preferably four, of the rod engagement locations comprise an aperture through connector body 36 providing both upper and lower contact points for lever rod 76 (on an upper surface (or portion of a top half) and a lower surface (or portion of a bottom half) of lever rod 76) to contact connector body 36 when lever rod 76 is actuated between raised and lowered positions. Preferably, at least one, more preferably two, of the rod engagement locations comprise only upper contact points for an upper surface (or portion of a top half) of lever rod 76 to contact connector body 36, without contact between a lower surface of lever rod 76 and connector body 36. For ease of insertion of rod 76 through apertures 38, 40, it is preferred that the apertures have a larger size or diameter than rod 76 so that top and a bottom surface of rod 76 do not simultaneously contact an interior surface of the apertures, but one or more of the apertures may also be sized so that the a portion of a top surface and a portion of a bottom surface of rod 76 simultaneously contact an interior surface of the apertures.

Figure 9:
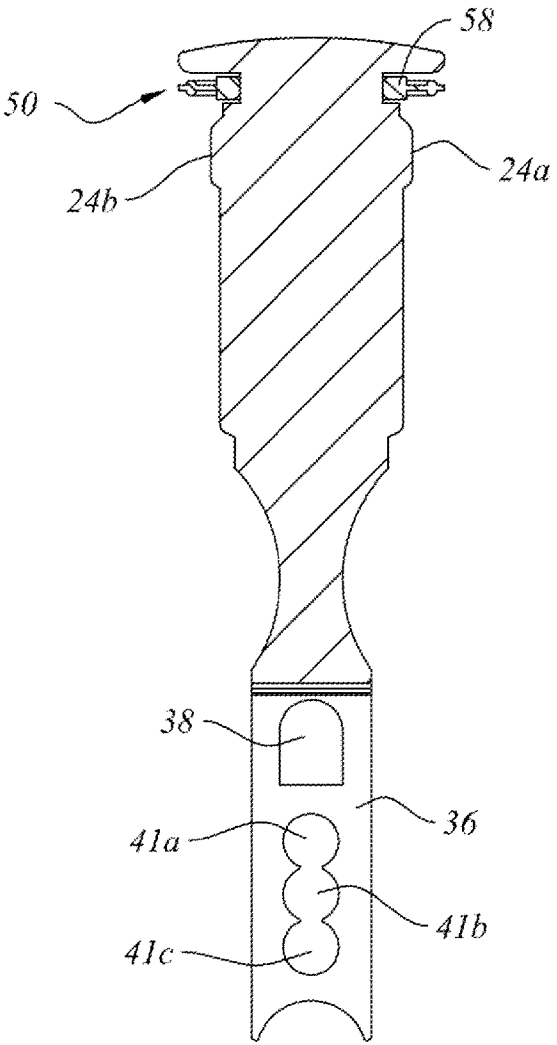
FIG. 9 is a front elevation cross sectional view of the pop up stopper of FIG. 2 with a seal of FIG. 7.

Seal 50 preferably comprises an outer annular flange 52, an outer annular ring 54 disposed inwardly of flange 52, a central annular disk 56 disposed inwardly of ring 54, a central body 58 disposed inwardly of disk 56, and a central aperture 62. Seal 58 is configured to fit within and be received by annular recess 21 around neck 16, with neck 16 disposed through aperture 62. Seal 50 preferably has an outer diameter (the outer diameter of outer annular flange 52) of around 1.35 to 1.45 inches, most preferably around 1.38 inches. Aperture 62 preferably has a diameter of around 0.7 to 0.72 inches, most preferably around 0.71 inches. Outer annular ring 54 aids in sealing cap 12 to a basin around a drain opening in which stopper 10 is installed when stopper 10 is in a lowered (closed) position by providing increased surface area. Outer annular ring 54 preferably has a height (when installed on stopper 10, measured in a direction from cap 12 toward connector body 36, as shown in FIG. 9) of around 0.06 to 0.08 inches, most preferably around 0.078 inches, and preferably has a width (between an inner edge annular flange 52 and an outer edge of disk 56) of around 0.04 to 0.06 inches, most preferably around 0.05 inches. Outer annular ring 54 preferably has rounded top and bottom surfaces having a radius of around 0.025 to 0.035 inches, most preferably around 0.03 inches.

Outer annular flange 52 and central disk 56 preferably have a height of around 0.025 to 0.035 inches, most preferably around 0.028 inches. Outer annular flange 52 preferably has a width (from its outermost edge to an outermost edge of annular ring 54) of around 0.03 to 0.05 inches, most preferably around 0.04 inches. Central disk 56 preferably has a width (from an inner edge of ring 54 to shoulder 64 at an outer edge of central body 58) of around 0.09 to 0.11 inches, most preferably around 0.1 inches. Central body 58 preferably has a height (when installed on stopper 10, measured in a direction from cap 12 toward connector body 36) of around 0.1 to 0.125 inches, most preferably around 0.12 inches, and preferably has a width (between shoulder 64 and an inner face 60) of around 0.13 to 0.14 inches, most preferably around 0.135 inches. Central body 58 preferably has substantially squared outer shoulders 64 (near disk 56) and rounded inner shoulders 66 having a radius of around 0.035 to 0.05 inches, most preferably around 0.04 inches. Central body 58 also preferably has a substantially flat inner face 60 disposed between shoulders 66 to contact sidewalls of cylindrical neck 16. References to widths with respect to parts of seal 50 are the horizontal measurement of the component on one side of aperture 62, not a diameter of the entire annular component.

Most preferably, the widest portion of stopper 10 disposed below cap 12 (excluding seal 50), and the widest portion of stopper 10 disposed below seal 50, is on stopper upper body 14, most preferably at upper tabs 24. The maximum width of stopper 10 below cap 12 (excluding seal 50 and as measured in widest cross section, such as shown in FIG. 9) is preferably 1.04 inches or less to ensure that stopper 10 will fit inside a drain opening and drain pipe into which stopper 10 is inserted while allowing ease of up and down movement of stopper 10 to allow the drain opening to be plugged or opened without interference from stopper upper body 14 or stopper lower body 20. When four fins 22 disposed at 90° angles are used, stopper upper body 14 preferably has a maximum width measured from one upper tab (such as 24*a*) across to another upper tab (such as 24*b*) disposed 180° from each other (as shown in FIG. 9) of 1.04 inches or less to ensure that stopper 10 will fit inside and easily move within a drain opening into which stopper 10 is inserted. When other fin arrangements are used (such as three fins, each spaced apart 120° from an adjacent fin), then a circle disposed around an outer edge of each upper tab 24 preferably has a diameter of 1.04 inches or less.

Upper stopper body 14, lower stopper body 12, and cap 12 are preferably integrally formed of plastic, but may also be separate components and made of other suitable materials, such as brass, zinc, or other metallic materials may also be used. Cap 12 may also be made of or covered with a metal or metallic coating for durability and/or aesthetic purposes. Seal 50 is preferably made of nitrile rubber, but other suitable materials, such as silicone, EPDM, TPV, TPE, or other elastomeric materials may also be used. The components of seal 50 is preferably integrally formed as one unit, but separate components (such as a one or two piece outer annular ring 54 separate from the other components that are integrally formed) may also be used and stacked together, preferably attached with adhesive.

Stopper 10 preferably does not comprise any prongs, separated or spaced apart legs, or channels that are open at one end (such as a bottom end of lower body 20) as part of its upper body 14 or lower body 20. Stopper 10 may comprise a magnetic material to aid in engaging with a magnetic lever rod, particularly for non-aperture rod engagement locations (such as connector plate 32 or notch 34 or bottom end 42), but it is preferred that stopper 10 not comprise any magnetic parts along upper body 14 and/or lower body 12.

A method of installing or using a stopper according to a preferred embodiment of the invention comprises: (1) loosening or removing a retention nut on the drain pipe that holds a lever rod in position (and disconnecting the lever rod from the extension rod as needed); (2) removing the lever rod from the drain pipe (disconnecting it from the existing stopper, if any); (3) to removing the existing stopper, if any; (4) inserting a new stopper, preferably a stopper 10 according to a preferred embodiment of the invention, into a drain opening in a basin with a cap remaining in the basin and a connector body extending downwardly into the drain pipe; (5) position stopper, rotating as needed, to selectively align one of a plurality of rod engagement locations with a lever rod; (6) engaging the lever rod with one of the rod engagement locations; (7) tightening the retention nut and reconnecting the lever rod to the extension rod, if needed. According to another preferred embodiment, a method of installing or using a stopper further comprises: (8) testing the stopper by pulling and pushing on a pull rod to see if the stopper opens and closes properly with the selected rod engagement location; (9) if the stopper does not open and close properly, repeating steps (1), (2), and (5) to re-align the stopper with a different rod engagement location; (10) repeating step (8) to see if the stopper opens and closes properly with the new selected rod engagement location. Steps 8-10 can be repeated for additional rod engagement locations as needed until the stopper functions properly to open and close the drain opening. According to another preferred embodiment when a connected, notched aperture rod engagement location is selected in step (5), then selecting a different rod engagement location in step (9) requires the lever rod to be removed from the connected aperture even if the next selected rod engagement location is another of the connected apertures because the notched channel between the connected apertures is not configured to allow the lever rod to pass through the channel from one connected aperture to another connected aperture. According to another preferred embodiment when a connected, notched aperture rod engagement location is selected in step (5), then step (9) may comprise applying an upward or downward force on a cap of stopper from within the basin to force the lever rod to move from one connected aperture (such as 40*a* to 40*b* or 40*b* to 40*a*) to the next connected aperture to engage the lever rod with a different rod engagement location in a set of connected rod engagement locations without having to remove the lever rod from one aperture to insert it in the next connected aperture.

As used herein, references to above, up, upper, top or the like refer to a direction from connector body 36 toward cap 12 or from a main drain pipe toward a sink basin (as in the cap 12 is above connector body 36 when stopper 10 is installed in a drain opening and the sink basin is above the main drain pipe). Similarly, as used herein, references to below, down, bottom, or lower or the like refer to a direction from cap 12 toward connector body 36 or from a sink basin toward a drain pipe. As used herein, length or height or vertical generally refers to a measurement in a direction parallel with longitudinal axis 48 (from cap 12 toward connector body 36) and width or horizontal generally refers to a measurement in a direction perpendicular to longitudinal axis 48. Any component, feature, or step of a preferred embodiment herein may be used with any other components, features, or steps of other embodiments or alternatives even if not specifically described with respect to that embodiment or alternative. Any dimension described herein within preferred ranges may be used in any individual value within such ranges or any subset of such range, even if the specific subset of the range is not specifically described herein, and including subset ranges than overlap the end values of more preferred ranges. Those of ordinary skill in the art will also appreciate upon reading this specification and the description of preferred embodiments herein that modifications and alterations to replacement stoppers may be made within the scope of the invention and it is intended that the scope of the invention disclosed herein be limited only by the broadest interpretation of the appended claims to which the inventors are legally entitled.

What is claimed is:

1. A pop up stopper for a basin drain opening, the pop up stopper comprising:

a stopper body comprising (1) a first rod engagement location configured to be engageable with a top surface of a portion of a lever rod and a bottom surface the portion of the lever rod, (2) a second rod engagement location configured to be engageable with the top surface of the portion of the lever rod and the bottom surface the portion of the lever rod, and (3) a third rod engagement location configured to be engageable with the top surface and not the bottom surface of the portion of the lever rod;

wherein the third rod engagement location comprises a notch disposed in a bottom surface of a connector plate and the notch is configured to receive the portion of the lever rod;

wherein the first rod engagement location, the second rod engagement location, and the third rod engagement location are spaced apart from each other longitudinally on the stopper body.

2. The pop up stopper according to claim 1 wherein there is no magnetic attachment between the portion of the lever rod and the notch.

3. The pop up stopper according to claim 1 wherein there is no magnetic attachment between the portion of the lever rod and the bottom surface of the connector plate.

4. The pop up stopper according to claim 1 wherein the stopper body comprises an upper body and a lower body, wherein the lower body comprises the connector plate and a connector body disposed below the connector plate.

5. The pop up stopper according to claim 4 wherein the first rod engagement location and the second rod engagement location are disposed on the connector body.

6. The pop up stopper according to claim 5 further comprising a fourth rod engagement location comprising a bottom end of the connector body, wherein the fourth rod engagement location is configured to be engageable with the top surface of the portion of the lever rod and not the bottom surface of the portion of the lever rod.

7. The pop up stopper according to claim 6 wherein the bottom end of the connector body comprises an arc.

8. The pop up stopper according to claim 5 wherein the first rod engagement location comprises a first aperture; and wherein the second rod engagement location comprises a set of two or more connected apertures that form a notched vertical channel that is closed at its upper end and at its lower end and each of the set of two or more connected apertures is a separate rod engagement location so that the pop up stopper has at least four rod engagement locations.

9. The pop up stopper according to claim 8 wherein a point of connection between each one of the set of two or more connected apertures and an adjacent one of the set of two or more connected apertures comprises a passage that is configured to be too small to allow the portion of the lever rod to pass through the passage.

10. The pop up stopper according to claim 8 wherein a point of connection between each one of the set of two or more connected apertures and an adjacent one of the set of two or more connected apertures comprises a passage that is configured to allow the portion of the lever rod to pass through the passage.

11. The pop up stopper according to claim 8 wherein the first aperture is substantially D-shaped with a straight bottom, straight sides, and a rounded top.

12. The pop up stopper according to claim 4 further comprising a fourth rod engagement location configured to be engageable with the top surface of the portion of the lever rod and not engageable with the bottom surface of the portion of the lever rod; and wherein the upper body has a central longitudinal axis;

wherein the connector body is disposed in a position parallel to and offset from the central longitudinal axis;

wherein the fourth rod engagement location comprises a bottom end of the connector body; and wherein there is no magnetic attachment between the portion of the lever rod and the notch.

13. The pop up stopper according to claim 12 wherein there is no magnetic attachment between the portion of the lever rod and the bottom surface of the connector plate.

14. The pop up stopper according to claim 12 wherein the first rod engagement location comprises a first aperture disposed on an upper end of the connector body;

wherein the second rod engagement location comprises a set of three or more connected apertures that form a notched vertical channel that is closed at its upper end and at its lower end and each of the set of three or more connected apertures is a separate rod engagement location so that the pop up stopper has at least six rod engagement locations.

15. The pop up stopper according to claim 1 wherein the stopper body is configured to be disposed inside a drain body connected to the basin drain opening and a widest part of the stopper body measured in cross-section is no more than 1.04 inches.

16. The pop up stopper according to claim 1 further comprising a plurality of spaced apart fins disposed above the first rod engagement location, the second rod engagement location, and the third rod engagement location and wherein a circle disposed around an outer edge of the plurality of spaced apart fins has a maximum diameter of 1.04 inches.

17. The pop up stopper according to claim 1 wherein the notch is rounded and the portion of the lever rod is cylindrical.

18. The pop up stopper according to claim 1 further comprising:

a cap disposed above the stopper body; and a seal disposed around an upper portion of the stopper body below the cap.

19. The pop up stopper according to claim 18 wherein the cap is integrally formed with the stopper body.

20. The pop up stopper according to claim 18 wherein a widest part of the stopper body measured in cross-section is no more than 1.04 inches.

21. The pop up stopper according to claim 20 wherein a widest part of the cap measured in cross-section is wider than the widest part of the stopper body measured in cross-section.

22. The pop up stopper according to claim 18 wherein the seal comprises a central aperture, a central body extending outwardly from the central aperture, a disk extending outwardly from the central body, a ring extending outwardly from the disk, and an outer flange extending outwardly from the ring; and wherein the ring has a height that is greater than a height of the disk and greater than a height of the outer flange and less than a height of the central body.

23. The pop up stopper according to claim 22 wherein the ring has a height of around 0.06 to 0.08 inches.

24. The pop up stopper according to claim 23 wherein the stopper body has a maximum width as measured in cross section of 1.04 inches and wherein the cap has a diameter of 1.3 to 1.4 inches.

25. The pop up stopper according to claim 1 wherein the stopper body does not comprise any prongs, spaced apart legs, or channels that are open at a bottom end.

26. A pop up stopper for a basin drain opening, the pop up stopper comprising:

a body comprising a first rod engagement location and a second rod engagement location;

a cap disposed above the body;

a seal disposed around an upper portion of the body below the cap and comprising a central aperture, a central body extending outwardly from the central aperture, a disk extending outwardly from the central body, a ring extending outwardly from the disk, and an outer flange extending outwardly from the ring, wherein the ring has a height that is greater than a height of the disk and greater than a height of the outer flange and less than a height of the central body;

wherein the first rod engagement location and the second rod engagement location are spaced apart from each other longitudinally on the body;

wherein the first rod engagement location is configured to be engageable with a top surface of a portion of a lever rod and a bottom surface of the portion of the lever rod to selectively actuate the pop up stopper between an open position and a closed position;

wherein the second rod engagement location is configured to be engageable with the top surface of the portion of the lever rod but not engageable with the bottom surface of the portion of the lever rod to selectively actuate the pop up stopper to an open position and allow the pop up stopper to fall to a closed position by gravity;

wherein the second rod engagement location is further configured to prevent the lever rod from slipping when engaged with the top surface of the portion of the lever rod; and wherein the seal is configured to engage with the basin drain opening to close the basin drain opening to flow when the pop up stopper is in the closed position and to disengage with the basin drain opening to open the basin drain opening to flow when the pop up stopper is the open position.

27. The pop up stopper according to claim 26 wherein the cap and body are integrally formed.

28. The pop up stopper according to claim 26 wherein the ring has a height of around 0.06 to 0.08 inches.

29. The pop up stopper according to claim 26 wherein the body has a maximum width as measured in cross-section of 1.04 inches and wherein the cap has a diameter of 1.3 to 1.4 inches.

30. The pop up stopper according to claim 26 wherein the body comprises a connector plate disposed below the seal; and wherein the second rod engagement location comprises a notch disposed in a bottom surface of the connector plate.

31. The pop up stopper according to claim 26 wherein the body comprises a connector body disposed below the seal;

wherein the second rod engagement location comprises an arced bottom end of the connector body.

* * * * *